United States Patent [19]

Spiegal

[11] Patent Number: 4,530,898

[45] Date of Patent: Jul. 23, 1985

[54] PHOTOGRAPHIC PRODUCTS AND PROCESSES PROVIDING A NEGATIVE IMAGE

[75] Inventor: Arnold Spiegal, Sharon, Mass.

[73] Assignee: Polaroid Corporation, Cambridge, Mass.

[21] Appl. No.: 584,724

[22] Filed: Feb. 29, 1984

[51] Int. Cl.[3] ..... G03C 1/48; G03C 5/26; G03C 5/38; G03C 5/39

[52] U.S. Cl. ..... 430/403; 430/411; 430/416; 430/418; 430/419; 430/427; 430/428; 430/434; 430/497; 430/598

[58] Field of Search ..... 430/411, 416, 418, 419, 430/427, 428, 434, 497, 598, 403

[56] References Cited

U.S. PATENT DOCUMENTS

| | | | |
|---|---|---|---|
| 3,343,958 | 9/1967 | Morse | 430/428 |
| 3,536,488 | 10/1970 | Land | 430/228 |
| 3,615,438 | 10/1971 | Land | 430/419 |
| 3,721,562 | 3/1973 | Land | 430/419 |
| 3,894,871 | 7/1975 | Land | 430/228 |
| 3,990,895 | 11/1976 | Land | 430/383 |

*Primary Examiner*—Richard L. Schilling
*Attorney, Agent, or Firm*—Stanley H. Mervis

[57] ABSTRACT

Photographic film units and processes are disclosed which provide a negative image, wherein exposed silver is developed to high covering power silver and unexposed silver halide is reduced to low covering power silver.

14 Claims, 1 Drawing Figure

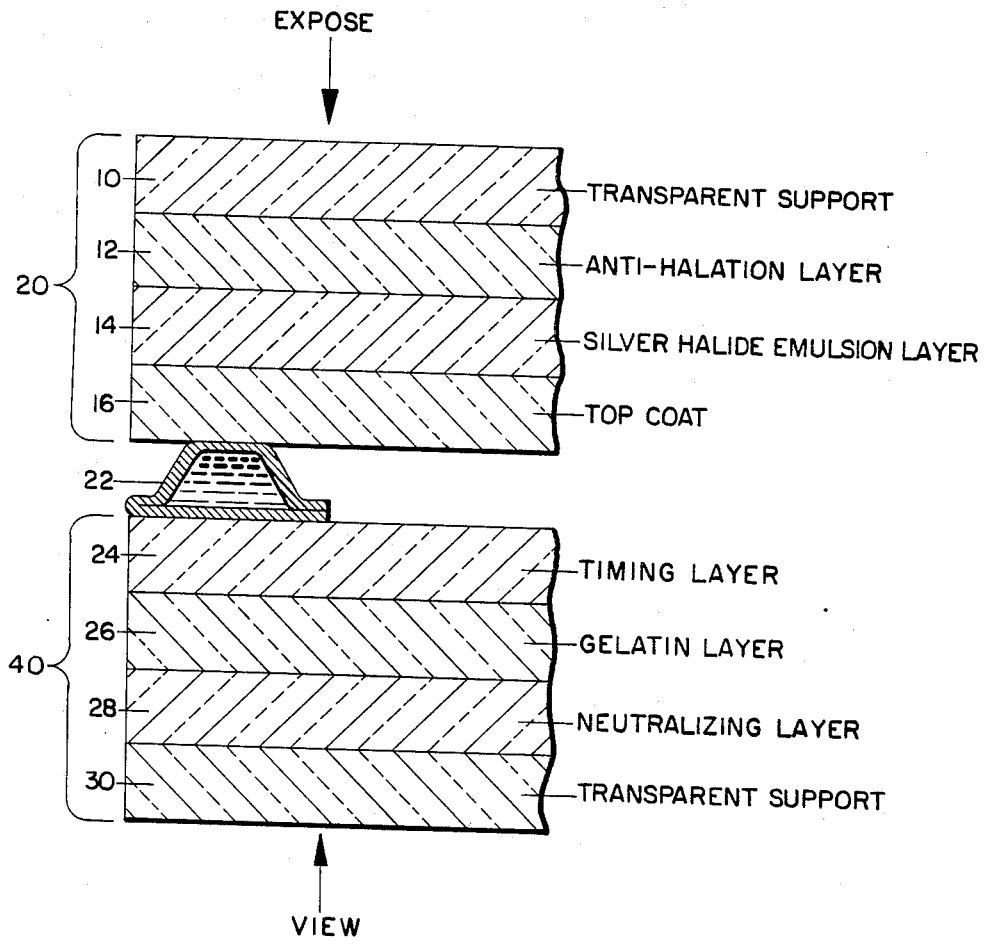
EXPOSE
10
12
14
16
20
TRANSPARENT SUPPORT
ANTI-HALATION LAYER
SILVER HALIDE EMULSION LAYER
TOP COAT
22
24
26
28
30
40
TIMING LAYER
GELATIN LAYER
NEUTRALIZING LAYER
TRANSPARENT SUPPORT
VIEW

PHOTOGRAPHIC PRODUCTS AND PROCESSES PROVIDING A NEGATIVE IMAGE

This invention is concerned with photography and, more particularly, with photographic products and processes for forming negative images.

BACKGROUND OF THE INVENTION

While most rapid access and "instant" photographic products have been designed to provide a positive image, there has been interest in products which would provide a usable negative image. Thus, Type 55 P/N and Type 665 Polaroid Land films provide both a positive silver transfer image and a fully developed negative suitable for use as a negative in conventional printing techniques. In using these films, the positive and negative images are formed on separate supports, and the negative image is given a hardening and stabilizing treatment after separation from the positive image. U.S. Pat. No. 3,345,166 issued Oct. 3, 1967 to Edwin H. Land et al and U.S. Pat. No. 3,549,364 issued Dec. 22, 1970 to Meroe M. Morse disclose processes of this type.

U.S. Pat. No. 2,544,268 issued on Mar. 6, 1951 to Edwin H. Land discloses a process for forming a usable negative by dissolving unexposed silver halide and diffusing it into the layer of processing reagent which thereafter is separated from the developed silver halide emulsion layer.

U.S. Pat. No. 3,343,958 issued Sept. 26, 1967 to Meroe M. Morse discloses the use of a combination of cysteine and a nitrogenous base to form a complex of unexposed silver halide having sufficient stability that it would not be necessary to remove the complex from the developed negative image. U.S. Pat. No. 3,721,562 issued Mar. 20, 1973 to Edwin H. Land disclosed an integral system providing a usable negative, the unexposed silver halide being allowed to remain in the form of a stable complex, such as that disclosed in U.S. Pat. No. 3,343,958. The formation of pin holes in the resulting integral negative transparency was reduced by including a neutralizing layer in the spreader sheet.

U.S. Pat. No. 3,615,438 issued Oct. 26, 1971 to Edwin H. Land et al discloses the formation of negative images by solubilization and transfer of exposed silver halide.

U.S. Pat. No. 3,990,895 issued Nov. 9, 1976 to Edwin H. Land discloses the formation of an additive color negative image. The exposed silver halide was developed under conditions which give increased covering power. The unexposed silver halide could be removed by fixing, transferred to an image-receiving layer to provide a positive silver image, or retained in the developed negative.

U.S. Pat. 3,894,871 issued July 15, 1975 to Edwin H. Land discloses the formation of positive transparencies, both silver black and white and additive color, wherein the exposed silver halide is reduced to low covering power silver and the unexposed silver halide is converted to a high covering power silver in a layer containing silver precipitating nuclei.

U.S. Pat. No. 3,536,488 issued Oct. 27, 1970 to Edwin H. Land discloses the formation of positive additive color transparencies wherein the photosensitive silver halide emulsion layer contains silver precipitating nuclei and exposed silver halide is developed to low covering power silver and unexposed silver halide is converted to high covering power silver.

SUMMARY OF THE INVENTION

The present invention provides usable negative images in which the exposed silver halide has been reduced to high covering power silver and unexposed silver halide has been reduced to low covering power silver. The negative image may be present in an integral film format in which all the layers and the residual layer of processing composition are retained as an integral laminate, or the developed negative may be formed in a peel-apart format in which it is separated from the other components after development.

DETAILED DESCRIPTION OF THE INVENTION

In accordance with this invention, an exposed silver halide emulsion is developed to reduce the exposed silver halide to high covering power silver, and at least 75%, and preferably at least 80%, of the unexposed silver halide is reduced to low covering power silver in the same layer, i.e., in the silver halide emulsion layer.

The FIG. illustrates, in exaggerated cross-sectional form, a film unit incorporating this invention.

A photosensitive element 20 comprises a transparent support 10 carrying an anti-halation layer 12, a silver halide emulsion layer 14 and a top coat 16. A spreader sheet 40 comprises a transparent support 30 carrying a neutralizing layer 28, a gelatin layer 26 and a timing layer 24. A rupturable container pod 22 is positioned between the photosensitive element 20 and the spreader sheet 40 so as to distribute a processing fluid reagent in a thin layer between the surfaces of the respective sheet-like elements.

As illustrated, it is preferred to effect photoexposure through the transparent support 10 of the photosensitive element 20, and to view through the transparent support 30 of the spreader sheet 40. The anti-halation layer 12 contains one or more anti-halation dyes which may be selected from those known in the art as bleachable during processing, e.g., by an alkaline processing composition. A number of suitable anti-halation dyes are disclosed in British Pat. No. 1,482,156, and others will be apparent to those skilled in the art. In general, satisfactory results are obtained if the anti-halation dyes are coated to an optical transmission density of about 0.1. Gelatin is a preferred binder for the anti-halation dyes but other binders also may be used.

The top coat 16 is optional and may serve as an anti-abrasion and/or anti-blocking layer and may comprise, for example, gelatin or polyvinyl alcohol.

The timing layer 24 provides a time delay for the permeation of water to the gelatin layer 26 which acts as a water-absorbing layer. Delaying the permeation of water from the layer of processing fluid into the water-absorbing layer 26 assures availability in the photosensitive element of the water necessary to effect development of the silver halide emulsion layer. Gelatin layer 26 together with neutralizing layer 28 also provides a "sink" for chemicals contained in the processing fluid to reduce any tendency for crystallization or precipitation after processing has been completed and the integral film unit has "dried" by evaporation of water.

As indicated, gelatin is the preferred polymer for layer 26, although other polymers, e.g., polyvinyl alcohol, also may be used. The thickness of layer 26 is selected according to the amount of processing fluid to be applied per unit area. In the preferred embodiment, layer 26 comprises gelatin and an alkali-activated hardening agent, e.g., propylene glycol alginate; such a layer allows rapid swelling and water absorption once the timing layer has been permeated, and a controlled hardening or cross-linking of the gelatin so that the resulting integral negative becomes resistant to pressure deformation within a short time after processing is initiated.

Suitable materials for use as the timing layer are known in the art, and illustrative materials are described in U.S. Pat. Nos. 3,362,819, 3,419,839, 3,421,893, 3,455,686 and 3,575,701 as well as others.

The timing layer 24 may also act as an anti-abrasion and/or anti-blocking layer.

The processing fluid contains a film-forming polymer adapted to provide viscosity suitable for distributing the processing fluid in a thin layer of substantially uniform thickness between the superposed sheet-like elements of the film unit. Suitable polymers include sodium carboxymethyl cellulose and hydroxyethyl cellulose. The processing fluid typically includes an alkali, such as sodium, potassium or lithium hydroxide, and one or more silver halide developing agents. Anti-foggants and toning agents also may be present, as well as materials adapted to improve the stability of the negative image. A silver halide solvent such as sodium thiosulfate also may be present. In the preferred embodiments, a thiocyanate also is present. The inclusion of sodium sulfite is effective to bleach anti-halation dyes present in the film unit. The presence of a quaternary ammonium compound has been found to favor solution physical development.

In the preferred embodiments of this invention, the photosensitive element 20 and the spreader sheet 40 are secured in superposed relationship, e.g., by a suitable binding mask, as is well known in the art and as illustrated, for example, in FIGS. 7 and 8 of the above-noted U.S. Pat. No. 3,990,895 to which reference may be made. Where a number of such film units are stacked in a cassette, the possibility exists that light incident upon the top film unit in the cassette may pass through that film unit and effect a partial photoexposure of at least the next underlying film unit. This problem may be readily avoided by including in the spreader sheet bleachable dyes, e.g., anti-halation dyes, to provide a density, e.g., a transmission density of about 2.5, sufficient to prevent such "punch through". In the preferred embodiment of this invention, such bleachable dyes are included in the gelatin layer 26.

If desired, an anti-reflection coating may be provided on the outer surface of either or both of the transparent supports 10 and 30. Suitable anti-reflection coatings include those described in U.S. Pat. No. 3,793,022 issued Feb. 19, 1974 to Edwin H. Land, Stanley M. Bloom and Howard G. Rogers.

Suitable materials for neutralizing layer 44 are well known in the art. Preferred materials are polymeric acids, such as described in U.S. Pat. No. 3,362,819 issued Jan. 9, 1968 to Edwin H. Land to which reference may be made. A preferred polymeric acid is a partial butyl ester of poly(ethylene/maleic anhydride) copolymer. In general, it has been found desirable to have a final pH, as measured about a week after processing, of about 7.5 to 10. If the final pH is much lower, stability of the silver image may be adversely affected.

It will be recognized by those skilled in the art that film units of the type illustrated in the FIGURE are subject to post-exposure fogging if ejected directly from the camera or processing back into ambient light. This problem may be avoided by providing a light-proof enclosure or container for receiving the developing film unit upon ejection. Examples of suitable devices include those shown in U.S. Pat. No. 3,653,308 issued Apr. 4, 1972 to Irving Erlichman and in U.S. Pat. No. 4,032,937 issued June 28, 1977 to Joseph H. Wright.

As noted above, development of the exposed silver halide emulsion layer is effected in such a manner that the exposed silver halide is reduced to high covering power silver and the unexposed silver halide is reduced to low covering power silver. In effecting such development, it has been found to be advantageous to cause the unexposed silver halide to effect solution physical development at a limited number of sites to provide low covering power silver particles. One technique for achieving this result is to employ a developing composition adapted to cause fog or physical development of the unexposed silver halide after a short induction period relative to development of exposed silver halide is reduced by chemical development. This result can be assisted by using a silver halide emulsion which has been ripened under conditions adapted to encourage formation of an optimum number of fog centers to provide a limited number of sites for development. By adjusting the conditions of development and the characteristics of the silver halide emulsion, it is possible to reduce at least 75% of the unexposed silver halide to silver. In the preferred embodiments, at least 80% of the unexposed silver halide is reduced to silver. Since the unexposed silver halide has been reduced to silver, extended dark times are not necessary to prevent photolytic reduction with consequent density increases, a problem which is frequently present where one retains the unexposed silver in the negative image as a silver complex.

As will be apparent, both the high covering power silver deposits and the low covering power silver deposits are contained in the silver halide emulsion layer. Development of the unexposed silver halide is effected without silver precipitating nuclei being present in any layer of the developing film unit.

The silver halide emulsion may be selected from a variety of negative working emulsion types, provided that under the conditions of development exposed silver halide will be reduced to high covering power silver and unexposed silver halide will be reduced to low covering power silver. It has been found that the gelatin to silver halide ratio has an effect upon the covering power of the unexposed silver halide. Use of a gelatin to silver ratio of at least 1.2 by weight is preferred since lower ratios may give higher minimum densities. The ripening time of the silver halide grains may be modified to help produce the desired limited number of fog centers, as is known in the art.

The following example is given to illustrate the invention and is not intended to be limiting.

EXAMPLE

A photosensitive element was prepared by coating a 4 mil transparent polyethylene terephthalate film base with the following layers:

1. an antihalation layer comprising approximately 800 $mg/m^2$ of gelatin containing green and blue anti-halation dyes in a concentration effective to give a transmission density of about 0.1;

2. an orthochromatic sensitized silver halide emulsion layer comprising approximately 2800 $mg/m^2$ of silver as 0.59 micron (mean volume diameter) 4% silver iodobromide grains, approximately 3360 $mg/m^2$ of gelatin, approximately 336 mg/m$^2$ of sorbitol, and propylene glycol alginate at a concentration of about 30 mg per gram of gelatin; and 3. a top coat comprising approximately 325 mg/m$^2$ of gelatin and approximately 80 mg/m$^2$ of sorbitol.

A spreader sheet was prepared by coating a 4 mil transparent polyethylene film base with the following layers:

1. a neutralizing layer comprising approximately 6500 mg/m$^2$ of a mixture of 9 parts of a half butyl ester of poly(ethylene/maleic anhydride) copolymer and 1 part of polyvinyl butyral;

2. a layer comprising approximately 21,275 mg/m$^2$ of gelatin, approximately 9200 mg/m$^2$ of sorbitol, approximately 633 mg/m$^2$ of propylene glycol alginate and a mixture of green and blue anti-halation dyes in a concentration effective to give a transmission density of at least about 2.5; and 3. a timing layer comprising approximately 170 mg/m$^2$ of polyvinyl alcohol and about 17 mg/m$^2$ of silica particles having a diameter of about 3 to 4 microns.

A processing fluid was prepared comprising:

Sodium carboxymethyl cellulose: 540 g.
Sodium thiosulfate pentahydrate: 840 g.
Lithium hydroxide (10% aqueous solution by weight): 7056 g.
Potassium thiocyanate: 120 g.
Sodium sulfite (anhydrous): 600 g.
Boric Acid: 120 g.
N-ethyl pyridinium bromide (50% aqueous solution by weight): 180 g.
Tetramethyl reductic acid: 1080 g.
2,3,6-trimethyl-4-aminophenol hydrochloride: 35 g.
3,mercapto-5-cyclohexylthio-4-methyl-1,2,4-triazole: 18 g.
Water: 5700 g.

A film unit was formed by superposing the photosensitive element and the spreader sheet with the transparent supports outermost and with a pod containing the processing fluid positioned between the superposed sheets. A mask binder was applied as described above to complete the film unit which then was given a 2 meter candle second exposure to a step wedge target through the transparent support for the photosensitive element. The exposed film unit was passed through a pair of pressure rollers to rupture the pod and spread a layer of the processing fluid approximately 0.0026 inch thick between the superposed sheets. The film unit was kept in the dark for about 30 seconds to avoid post-exposure fogging by ambient light. The resulting negative image exhibited a maximum transmission density of about 2.80 and a minimum transmission density of about 0.30.

Analysis of negative images formed in the manner described in the above example showed that more than 80% of the silver halide in the unexposed areas (corresponding to the minimum density areas) was reduced to metallic silver. In making this analysis, the developed photosensitive element was separated from the spreader sheet and treated with a hypo solution to remove unreduced silver halide. X-ray fluorescence analysis was used to measure the silver remaining after the hypo treatment.

Residual unexposed silver halide present in the developed negative in the above example is believed to be present as a stable silver salt of the 3-mercapto-5-cyclohexylthio-4-methyl-1,2,4-triazole present in the processing fluid.

Experiments have shown that film units constructed in the manner described in the above example have good latitude with respect to the "gap" or thickness of the applied layer of processing fluid. A gap of about 0.0026 inch was found to give a coverage of processing fluid of about 6.5 mg/cm$^2$. Variations in this coverage within a range of about 5.2 to about 7.0 mg./cm$^2$ gave substantially the same sensitometric results.

30,000 × transmission electron micrographs of $D_{max}$ and $D_{min}$ areas of a negative image prepared in a manner similar to the above example clearly showed that the silver deposits in $D_{max}$ areas were filamentous in nature as expected in chemical development. The silver deposits in the $D_{min}$ areas were large clumps or grains spaced apart from each other to give low covering power.

It will be understood by those skilled in the art that the various coating solutions may and preferably do include small amounts of surfactants. Where appropriate, a bacteriostat also may be present. Anti-static agents also may be provided.

Although in the preferred embodiments of this invention the developed photosensitive element is maintained as a laminate with the spreader sheet, it is within the scope of this invention to separate the developed photosensitive elements. In the latter instance, the separated negative image may be treated with a hypo solution to remove residual silver salts.

What is claimed is:

1. A photographic process for forming a negative image comprising exposing a photosensitive sheet-like element comprising a transparent support carrying a layer containing a negative working gelatino silver halide emulsion, to form a latent image in exposed silver halide, distributing an aqueous alkaline processing fluid between said exposed photosensitive element and a superposed spreader sheet, developing said exposed silver halide to high covering power silver and reducing to low covering power silver at least 75% of the unexposed silver halide, whereby a visible negative image is formed in said silver halide emulsion layer.

2. A photographic process as defined in claim 1 wherein at least 80% of said unexposed silver halide is reduced to low covering power silver.

3. A photographic process as defined in claim 1 wherein said spreader sheet is transparent and includes a neutralizing layer, and said photosensitive element and said spreader sheet are maintained in superposed relationship after said negative image is formed thereby providing a laminate containing said negative image.

4. A photographic process as defined in claim 1 wherein said silver halide emulsion has a gelatin to silver ratio of about 1.2.

5. A photographic process as defined in claim 1 wherein said silver halide emulsion is adapted to undergo fog development at a limited number of sites in unexposed areas after chemical development of said exposed silver halide grains has been initiated.

6. A photographic process as defined in claim 1 wherein said processing fluid includes potassium thiocyanate.

7. A photographic process as defined in claim 1 wherein said processing fluid includes lithium hydroxide.

8. A photographic process as defined in claim 1 wherein said processing fluid includes tetramethyl reductic acid.

9. A photographic process as defined in claim 1 wherein said processing fluid includes a quaternary ammonium compound.

10. A photographic film unit adapted to provide a visible negative image, said film unit comprising a photosensitive element comprising a transparent support carrying a negative working silver halide emulsion, a rupturable container releasably holding a processing fluid; a spreader sheet in superposed relationship with said photosensitive element, or adapted to be brought into said superposed relationship, with said rupturable container positioned to release said processing fluid for distribution between said photosensitive element and said spreader sheet; said processing fluid being adapted to develop said silver halide emulsion to a negative image following photoexposure by developing exposed silver halide to high covering power silver and reducing at least 75% of the unexposed silver halide to low covering power silver.

11. A photographic film unit as defined in claim 10 wherein said spreader sheet is transparent and includes a neutralizing layer.

12. A photographic film unit as defined in claim 11 wherein said photosensitive element and said spreader sheet are held in superposed relationship and adapted to be maintained as a laminate after said negative image has been formed.

13. A photographic film unit as defined in claim 12 wherein said silver halide emulsion has a gelatin to silver ratio of about 1.2.

14. A photographic film unit as defined in claim 13 wherein said silver halide emulsion is adapted to undergo fog development at a limited number of sites in unexposed areas after chemical development of said exposed silver halide has been initiated.

* * * * *